United States Patent [19]

Newgard et al.

[11] Patent Number: 4,581,777

[45] Date of Patent: Apr. 15, 1986

[54] SEALABLE DISPENSER AND HANGER

[75] Inventors: Peter M. Newgard, Redwood City; Maria A. Geigel, Menlo Park, both of Calif.

[73] Assignee: The Drackett Company, Cincinnati, Ohio

[21] Appl. No.: 717,787

[22] Filed: Mar. 29, 1985

[51] Int. Cl.[4] ..... E03D 9/02

[52] U.S. Cl. ..... 4/228; 4/227; 4/222

[58] Field of Search ..... 4/228, 227, 222, 223; 222/424.5, 181, 431

[56] References Cited

U.S. PATENT DOCUMENTS

| | | | |
|---|---|---|---|
| 3,943,582 | 3/1976 | Daeninckx et al. | 4/228 X |
| 4,247,070 | 1/1981 | Dirksing | 4/228 X |
| 4,436,269 | 3/1984 | Dirksing et al. | 4/227 |
| 4,455,692 | 6/1984 | Hegge et al. | 4/228 |
| 4,459,710 | 7/1984 | Keyes et al. | 4/228 |
| 4,490,861 | 1/1985 | Dolan | 4/227 X |

*Primary Examiner*—Henry K. Artis
*Attorney, Agent, or Firm*—Charles Zeller

[57] ABSTRACT

A sealabe dispenser adapted for mounting in a liquid containing reservoir, said reservoir having closable and openable inlet and outlet ports, the level of the liquid in said reservoir being capable of being lowered and raised by the appropriate manipulation of said inlet and outlet ports, said dispenser comprising at least one storage chamber containing material to be dispensed into said liquid reservoir, said material to be dispensed from said storage chamber by means of said liquid flowing into and out of said storage chamber, said storage chamber being provided with liquid passage means for permitting said liquid to enter and leave said chamber in response to the level of the liquid in said reservoir and venting means to vent the interior of said storage chamber to the atmosphere, moveable sealing means cooperating with said liquid passage means and said venting means to seal and unseal said liquid passage means and said venting means.

8 Claims, 7 Drawing Figures

FIG. 1
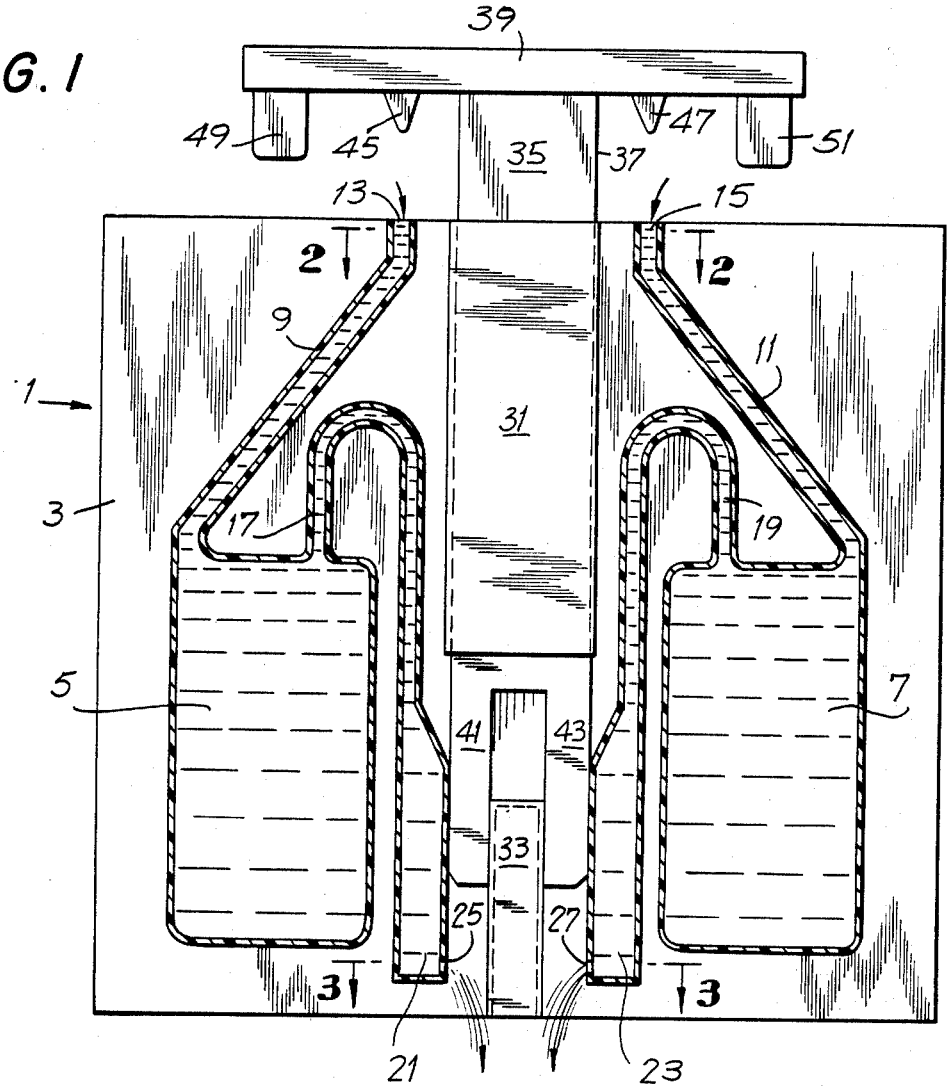
FIG. 2
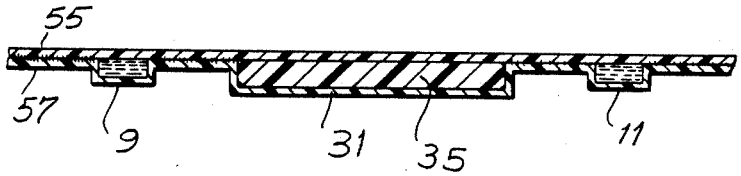
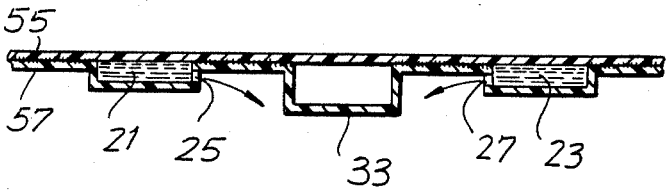
FIG. 3

FIG. 4
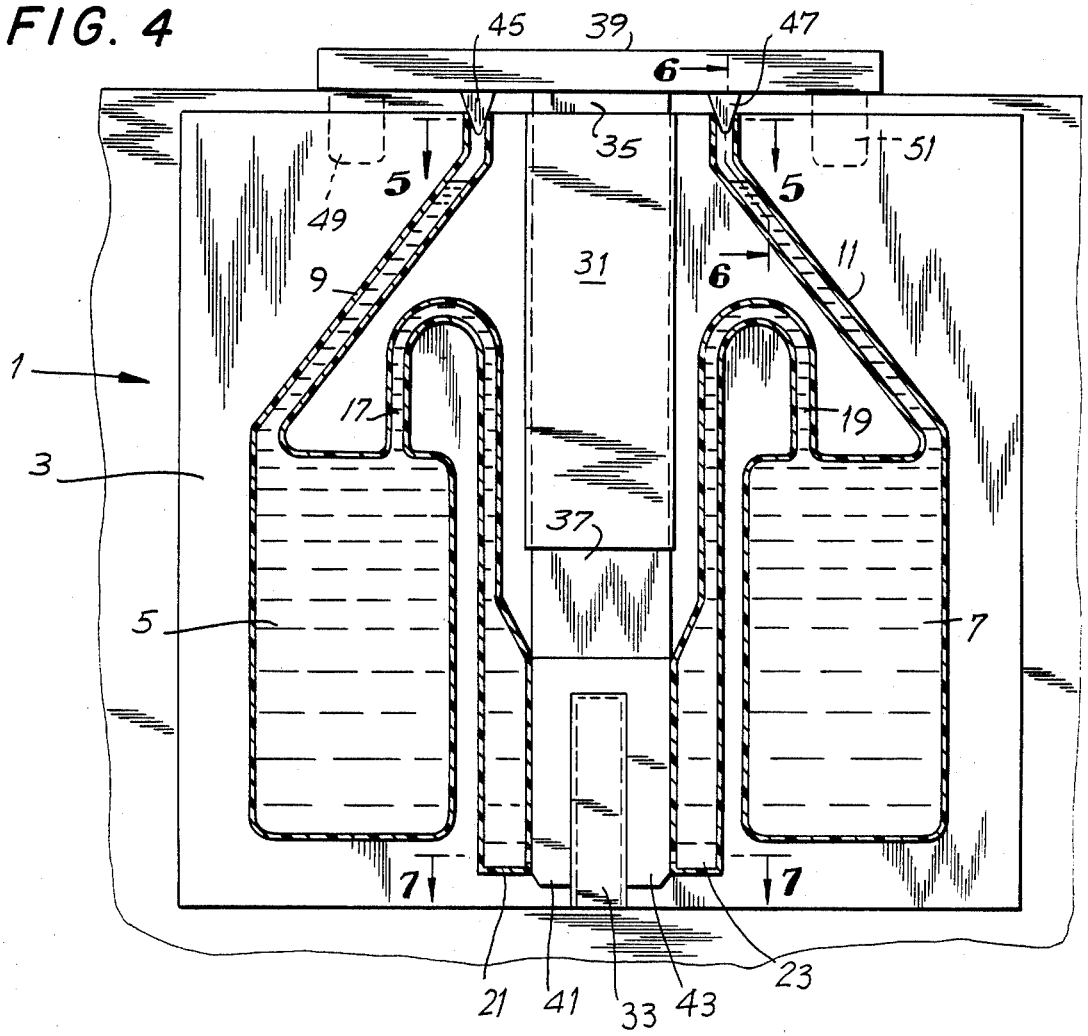
FIG. 6
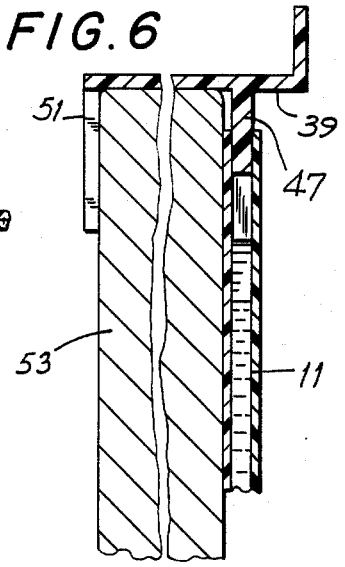
FIG. 5
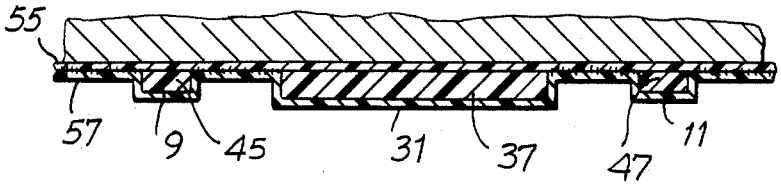
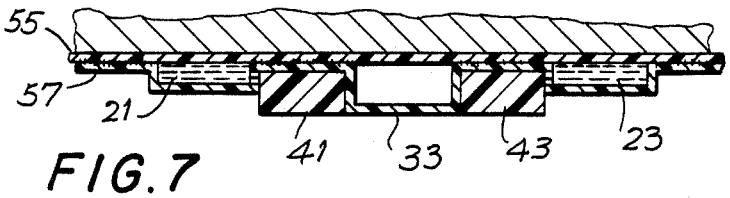
FIG. 7

SEALABLE DISPENSER AND HANGER

FIELD OF INVENTION

This invention relates to a sealable dispenser adapted to be mounted in a liquid reservoir to deliver material to said reservoir in response to the lowering and raising of the liquid level in said reservoir. More particularly, it concerns a dispenser of this character designed to be mounted in the water storage tank associated with a toilet and constructed so as to deliver material to said storage tank in response to the flushing of said toilet and the consequent lowering and raising of the water level in said storage tank.

BACKGROUND OF THE INVENTION

A number of dispensers are known in the prior art which are designed to be mounted in the water tank of a toilet and are adapted to deliver active materials to the water tank in response to the flushing of the toilet. In this connection attention is invited to U.S. Pat. Nos. 4,455,692 and 4,459,710. The devices of these and similar patents are provided with chambers that contain active chemical materials in solid form (e.g. cakes, tablets, powders granules). Associated with these chambers are openings in the dispenser that communicate with the interior of said chambers. These may be holes that are bored through wall of these chambers or may be bored through a conduit that leads into these chambers.

A number of problems would be encountered in connection with the use, storage and sale of products of the type described in the above identified patents. These are due, primarily, to the fact that an oxidizing agent is typically contained in at least one of the dual storage chambers of the dispenser and is free to get into the atmosphere. Typically, a detergent material is present in the other storage chamber, which detergent is generally incompatible with the oxidizing agent, intermixing of the detergent and the oxidizing agent possibly causing heat due to reaction. In addition, the packaging material that may be used to package the dispenser tends to become brown because of the interaction between escaping oxidizing agent and polyvinylchloride from which the packaging material is preferably made. Similarly, the dusting of the active agents into the atmosphere during storage and shipment are inclined to reach unsatisfactory levels. Furthermore, because of this dusting, it has become necessary to package these dispensers in plastic bags which add to the expense of the product. Moreover, the disposal of the product after its useful life is finished is complicated by the dripping and staining of especially the oxidizing agent when the dispenser is removed from the tank.

SUMMARY OF THE INVENTION

It has now been found that the above described disadvantages encountered in dispensers of the type with which the present invention is concerned can be avoided by providing movable sealing means for sealing the venting means and liquid passage means associated with storage chambers in said dispenser that serve to house the active ingredients that are to be dispensed into the liquid reservoir in which said dispenser is mounted.

It is accordingly an object of the present invention to provide a dispenser adapted to be mounted in a liquid reservoir to deliver active material to said reservoir in response to the raising and lowering the liquid level in said reservoir and having at least one active material storage chamber provided with an associated venting means and liquid passage means; said dispenser being provided with moveable sealing means for said venting means and liquid passage means whereby the escape of the active material to the atmosphere may be minimized or avoided.

Other and more detailed objects of this invention will be apparent from the following description, drawings and claims.

BRIEF DESCRIPTION OF THE DRAWINGS

FIG. 1 is a front view of a dispenser embodied in the present invention in the unsealed mode, the active material storage tanks and associated conduits being shown in vertical section;

FIG. 2 is a partial horizontal cross sectional view of the dispenser shown in FIG. 1 taken along line 2—2 of FIG. 1;

FIG. 3 is a partial horizontal cross sectional view of the dispenser shown in FIG. 1 taken along line 3—3 of FIG. 1;

FIG. 4 is a front view of the dispenser shown in FIG. 1 but shown in the sealed mode;

FIG. 5 is a partial horizontal cross sectional view of the dispenser shown in FIG. 4 taken along line 5—5 of FIG. 4;

FIG. 6 is a partial vertical cross sectional view taken along line 6—6 of FIG. 5 the back wall of the toilet tank also being shown to illustrate the manner by which the dispenser is hung on the tank;

FIG. 7 is a partial horizontal cross sectional view of the dispenser shown in FIG. 4 taken along line 7—7 of FIG. 4.

DESCRIPTION OF THE INVENTION

Referring now to the drawings wherein the same numerals refer to the same structure in the various views a dispenser embodied in the present invention is shown generally at 1. This comprises a backing 3 on which are mounted storage chambers 5 and 7, respectively. Any of a variety of active materials usually in the form of cakes, powders, pellets, or granules are disposed in these chambers for delivery to a water reservoir tank of a toilet assembly. By way of illustration in one embodiment of this invention a solid detergent composition is loaded into chamber 5, whereas chamber 7 is used to house an oxidizing agent system. Extending upwardly from each of the storage chambers 5 and 7 there are provided conduits 9 and 11, respectively, that are arranged at an angle with respect to the roof of each of the storage chambers 5 and 7, respectively. Each of these conduits 9 and 11 terminate in an opening 13 and 15, respectively. These openings serve as vents for chambers 5 and 7.

Extending upwardly and downwardly in a U-shaped arc are a further pair of conduits 17 and 19 that communicate with the interior of storage chambers 5 and 7, respectively. Each of these conduits 17 and 19 have broadened terminal portions 21 and 23 respectively. On the inner surface of portions 21 and 23 respectively is bored liquid passage openings 25 and 27 respectively. These serve to allow liquid contained in chambers 5 and 7 respectively to run out of these chambers when the liquid in the toilet tank drops below the appropriate level. Similarly it allows the liquid from the tank reservoir to flow back into chambers 5 and 7 respectively when the liquid level in the toilet tank rises to the appropriate level.

Secured to the front face of backing 3 is a hollow guide member 31. In the modification shown, guide 31 is rectangular in cross section and extends downwardly approximately one half the distance between the upper and lower margin of backing 3.

Extending upwardly from the lower margin of backing 3 and projecting outwardly therefrom is barrier member 33. This is firmly secured to backing 3 and serves as a stop for the downward movement of the T-shaped hanger element 35 as described in more detail below.

Hanger element 35 has a two fold function. The first is to provide a means by which dispenser 1 may be suspended in the water tank of a toilet. The second function is to provide a means for closing vent openings 13 and 15 as well as liquid passage openings 25 and 27.

T-shaped hanger member 35 has a vertical member 37 on which is superimposed crossbar member 39. The lower end of vertical member 37 is bifurcated to form legs 41 and 43 that straddle barrier member 33 when the hanger 35 is inserted into guide 31 as described in more detail below. Extending downwardly from the under-surface of crossbar 39 are a pair of triangularly shaped plug members 45 and 47. These are adopted to seal vent openings 13 and 15 respectively when the hanger 35 is inserted into guide 31.

Also extending downwardly from the under-surface of crossbar 39 near the ends thereof are a pair of hook elements 49 and 51. These are used to hang the dispenser inside a water tank of a toilet. This may best be seen with respect to FIG. 6 in which 53 is the back wall of a water tank.

The dispensers of the present invention may be fabricated using any of a number of techniques. In the preferred form of this invention backing 3 is fabricated from a pair of heat sealable plastic sheets 55 and 57 that are heat sealed together. Sheet 55 forms the back of backing element 3 whereas sheet 57 forms the front of backing 3. Before front 57 is secured to back sheet 55, the former is shaped to form the front and side of the various components mounted on backing 3, that is chambers 5 and 7 with their corresponding conduits 9 and 11 as well as U-shaped conduits 17 and 19 and their respective broadened areas 21 and 23. Similarly the face and side of guide element 31 and barrier element 33 are likewise shaped into front sheet 57. The active ingredients are then loaded into storage chambers 5 and 7 respectively and the back sheet 55 is heat sealed to front sheet 57. In this fashion, the chambers, conduits and the other elements of backing 3 are completed and the active ingredients are in position in storage chambers 5 and 7. The dispensers of the present invention are stored and shipped in the sealed mode, as shown in FIG. 4. In this mode the hanger element 35 has been positioned in guide 31 and pushed home so that plugs 45 and 47 seal openings 13 and 15 respectively, whereas the outside surface of legs 41 and 43 seal off openings 25 and 27 respectively.

When it is desired to use the dispenser of the present invention in a toilet tank or the like, the hanger 35 is pulled out to its unsealed mode as shown in FIG. 1. In this mode, the dispenser may be then hung on a wall of the tank using hooks 49 and 51 to support it in the tank. By means of a friction fit between the outer surface of vertical arm 37 and the inner surface of guide 31 or some similar expedient, backing 3 is prevented from separating from hanger 35 and falling into the water tank of the toilet.

When the dispenser of the present invention is hung in the water tank and the level of the water therein is high enough, water enters each of the liquid passage openings 25 and 27 and fills the chambers 5 and 7 to the liquid level in the tank. When the toilet is flushed the liquid level in the tank falls. At this time in the cycle the liquid drains from storage 5 and 7 carrying along with it some of the active material contained in storage tanks 5 and 7.

As indicated above, any of a variety of active ingredients may be contained in the storage chambers of 5 and 7 of the present invention. In the usual case the materials are stored in the separate chambers which are reactive with each other and whose action is not desired until the active ingredients from the separate chambers enter into the liquid in the toilet tank.

As indicated above in preferred form of this invention chamber 5 will contain a detergent composition in solid form whereas chamber 7 will house an oxidizing agent composition. Exemplary of the detergent compositions and the oxidizer compositions are those identified in U.S. Pat. No. 4,459,710 to Keyes et al, incorporated herein by reference.

The dispenser of this invention may be fabricated from any of a variety of materials. In fabricating backing 3 the sheet material used to form the front and back elements 55 and 57 will usually be made of the same or different heat sealable plastic materials. In addition, front 57 will be made of a plastic material which is capable of being formed usually under the influence of heat and pressure. By way of illustration the following plastic materials may be employed in forming elements 55 and 57: polyethylene, polypropylene and polystyrene. Hanger 35 is usually fabricated as a unitary molded piece employing preferably a moldable plastic material. Illustrative of the plastic materials that may be employed to mold hanger member 35, the following may be mentioned: polyethylene, polypropylene and polystyrene.

What is claimed is:

1. A sealable dispenser adapted for mounting in a liquid containing reservoir, said reservoir having closable and openable inlet and outlet ports, the level of the liquid in said reservoir being capable of being lowered and raised by the appropriate manipulation of said inlet and outlet ports, said dispenser comprising at least one storage chamber containing material to be dispensed into said liquid reservoir, said material to be dispensed from said storage chamber by means of said liquid flowing into and out of said storage chamber, said storage chamber being provided with liquid passage means for permitting said liquid to enter and leave said chamber in response to the level of the liquid in said reservoir and venting means to vent the interior of said storage chamber to the atmosphere, moveable sealing means cooperating with said liquid passage means and said venting means to seal and unseal said liquid passage means and said venting means.

2. A sealable dispenser according to claim 1 wherein said moveable sealing means comprises an elongated member having associated at two sealing surfaces, a first sealing surface for sealing the liquid passage means when said sealing means is in the sealing position and a second sealing surface comprising a protrusion for sealing said venting means when said sealing member is in sealing position, said liquid passage means and said venting means being simultaneously sealed or unsealed by the movement of said elongated member.

3. A sealable dispenser according to claim 2 wherein said elongated member comprises a vertically extending portion and a horizontally extending portion, one of said sealing surface comprising a protrusion protruding from said horizontally extending portion and the other sealing surface being positioned over said vertically extending portion.

4. A sealable dispenser according to claim 3 wherein said elongated member is also provided with means for suspending said dispenser in said reservoir.

5. A sealable dispenser adapted for mounting in a liquid containing reservoir, said reservoir having closable and openable inlet and outlet ports, the level of the liquid in said reservoir capable of being lowered and raised by the appropriate manipulation of said inlet and outlet ports, said dispenser comprising a support, a pair of storage chambers mounted on said support, each of said storage chambers being provided with an air conduit terminating in an air vent and a liquid conduit terminating in a liquid passage port, each of said storage chambers containing solid material to be dispensed into said liquid reservoir by means of liquid flowing into and out of storage chambers through said liquid passage ports in response to the different levels of the liquid in said reservoir; a T-shaped moveable sealing means moveably mounted in said support and disposed between said storage chambers, a pair of spaced protrusions extending from the cross bar of said T-shaped sealing means, said pair of protrusions being positioned to seal said air vents when said sealing means is in the sealing position, a sealing surface positioned on the vertical bar of said T-shaped sealing means and on opposite sides of said sealing means, said sealing surface being positioned to seal said liquid passage ports when said sealing means is in the sealed position.

6. A sealable dispenser according to claim 5 wherein said sealing means is also provided with means for hanging said dispenser in said liquid reservoir.

7. A sealable dispenser according to claim 6 wherein said liquid reservoir is a toilet tank containing water.

8. A sealable dispenser according to claim 7 wherein the solid material contained in one storage chamber is a detergent composition and the solid material contained in the other storage chamber is an oxidizing agent composition.

* * * * *